United States Patent [19]

Blagg

[11] Patent Number: 4,762,323

[45] Date of Patent: Aug. 9, 1988

[54] GAME APPARATUS AND METHOD

[76] Inventor: Dennis Blagg, 2620 Willing Ave., Fort Worth, Tex. 76110

[21] Appl. No.: 934,915

[22] Filed: Nov. 21, 1986

[51] Int. Cl.[4] ..... A63F 3/00

[52] U.S. Cl. ..... 273/126 R; 273/94; 273/128 R; 273/127 R

[58] Field of Search ..... 273/94, 126 R, 247, 273/353, 128 R, 347, 259, 108, 288, 289, 85 R, 127 R

[56] References Cited

U.S. PATENT DOCUMENTS

| | | | |
|---|---|---|---|
| 500,409 | 6/1893 | Monks | 273/94 |
| 808,111 | 12/1905 | Pell | 273/94 |
| 1,190,003 | 7/1916 | Quinn | 273/259 |
| 1,712,781 | 5/1929 | Williams | 273/94 |
| 2,442,251 | 5/1948 | Ullenberg | 273/126 R |
| 2,517,460 | 8/1950 | Arnn | 273/94 |
| 3,573,869 | 3/1969 | Duckett | 273/347 |
| 4,261,568 | 4/1987 | Such | 273/85 R |
| 4,555,114 | 11/1985 | Dozler | 273/126 R |

FOREIGN PATENT DOCUMENTS

| | | | |
|---|---|---|---|
| 476811 | 9/1951 | Canada | 273/126 R |
| 622396 | 11/1935 | Fed. Rep. of Germany | 273/85 R |
| 2115707 | 9/1983 | United Kingdom | 273/85 R |

*Primary Examiner*—Anton O. Oechsle
*Assistant Examiner*—Mark S. Graham
*Attorney, Agent, or Firm*—James E. Bradley

[57] ABSTRACT

A board game representing a sport, such as football. The game has a playing board, which represents the playing field. Player disks represent players, and a ball disk represents the football. The ball disk has beveled edges, so that it will slide over the player piece when the ball disk is propelled across the playing board. The ball disk is propelled by thumping the ball disk with a finger.

8 Claims, 2 Drawing Sheets

GAME APPARATUS AND METHOD

BACKGROUND OF THE INVENTION

1. Field of the Invention

This invention relates in general to the field of board games. In particular, this invention relates to the field of board games which represent sports, such as football or basketball.

2. Description of the Prior Art:

Board games which represent the sport of football have been popular for many years. Many different games have been designed to use the rules and to simulate the action of the sport as much as possible. There are, of course, limits on a board game's ability to simulate the physical action of a field sport. However, a board game can reproduce some of the strategy and elements of luck in the sport, and can simulate the results of various decisions made during the course of the game.

Most football board games have flat playing boards, which represent the football playing field. Many of the games also have playing pieces, which represent individual football players. The playing pieces are moved around the playing board in various manners, in order to simulate the movement of players on a field.

One of the most difficult aspects of the sport for a board game to simulate is the forward pass play. In a pass play, one player attempts to throw a football through the air to a teammate. A pass play has several possible results: the pass can be complete, if the ball is caught by a teammate of the passer; the pass can be incomplete, if no one catches the ball; or the pass can be intercepted, if the ball is caught by a player on the defensive team.

The challenge to a board game is to simulate a forward pass play in a realistic manner. To be realistic, there must be a reasonable chance for each of the possible results to occur. Many board games use dice, or some other random number generator, and a possibility chart to give a statistically accurate result. While the results may be accurate, such games lack some of the realism of the forward pass.

Other games have a playing piece, representing the ball, which is actually propelled through the air, or across the surface of the board, to simulate the flight of the football from the passer to the receiver. However, these games generally fail to provide an accurate chance for each of the possible results: completed pass, incomplete pass, and interception.

A need therefore existed for a board game which could accurately simulate the flight of the football from passer to receiver, and still give a realistic chance for each possible result. The game apparatus of the invention is such a game.

SUMMARY OF THE INVENTION

The general object of this invention is to provide a board game which could accurately simulate the flight of a ball, such as a football, from passer to receiver, and still give a realistic chance for each possible result. The game can also be used in board games representing other sports, such as basketball or soccer.

The game of the invention has a flat playing board, which represents a playing field. A plurality of player disks are placed on the playing board to represent players. The player disks are moved around the playing board according to rules which closely approximate the rules of the sport.

The player disks are relatively flat and may be shaped like a football helmet or in some other appropriate shape. The lower side of the player disks is smooth, to facilitate moving the player disks around the playing board. The upper side of the player disks may be roughened.

The ball is represented by a ball disk on the playing board. The ball disk is also flat, and may be shaped like the ball used in the sport, either oblong like a football, or round like a basketball, for example.

The lower side of the ball disk is smooth, to facilitate movement of the ball disk across the playing board. The edges of the ball disk are beveled, so that the upper side of the ball disk is larger than the lower side. Thus, when the ball disk is propelled across the playing board, the ball disk may slide onto or over the player disks. If a proper amount of force is used to propel to ball disk, the ball disk will stop on top of a selected player disk. If an excessive amount of force is used, the ball disk will slide over the player disk.

During the play of the game, the player disks and the ball disk are placed on the playing board. The ball disk is then thumped with a finger, to propel the ball disk across the playing board toward a selected player disk.

If the force and the direction of the thumping is accurate, the ball disk will slide onto the selected player disk, and the ball disk and the player disk may move a short distance together. If the force or the direction of the thumping is not accurate, the ball disk may slide onto a different player disk or the ball disk may not slide onto any player disk. The game thus simulates the flight of the ball, and yet gives a realistic chance for a completed pass, an intercepted pass, or an incomplete pass.

The above, as well as additional objects, features, and advantages of the invention, will become apparent in the following detailed description.

DESCRIPTION OF THE PREFERRED EMBODIMENT

Figure 1:
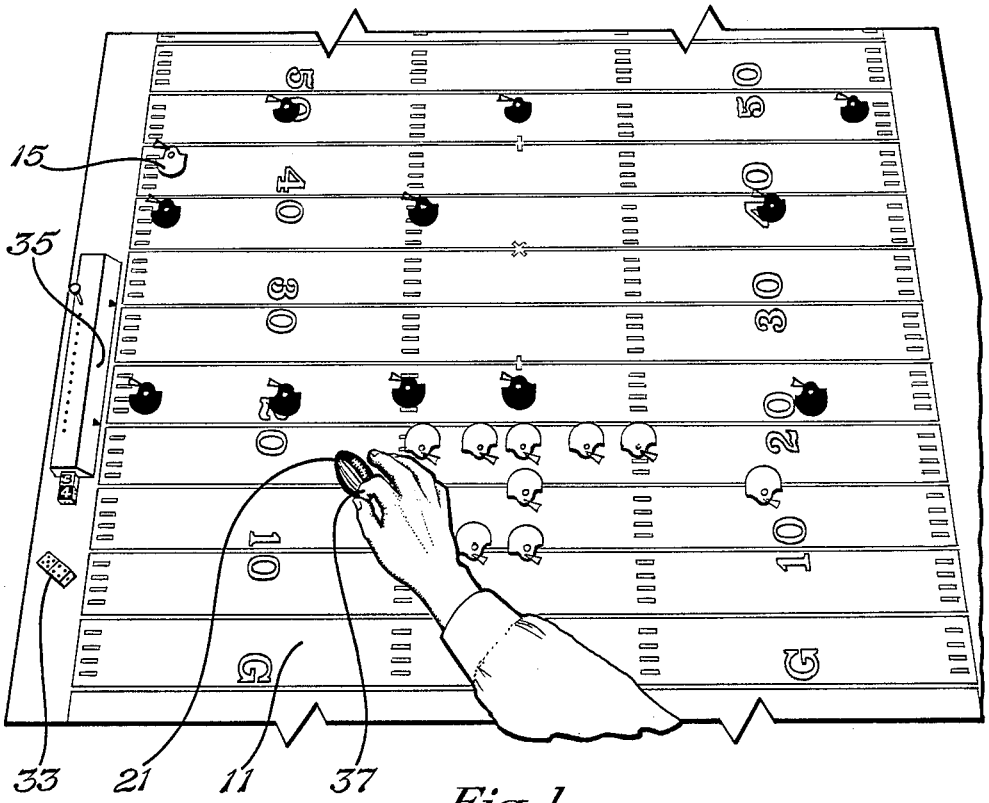
FIG. 1 is a perspective view of the game apparatus of the invention.

Although the game apparatus and method of the invention is applicable to several different sports, the game and method is particularly adapted to represent the sport of football. Therefore, the preferred embodiment of the invention, shown in the drawings, is a board game which represents the sport of football.

Figure 2:
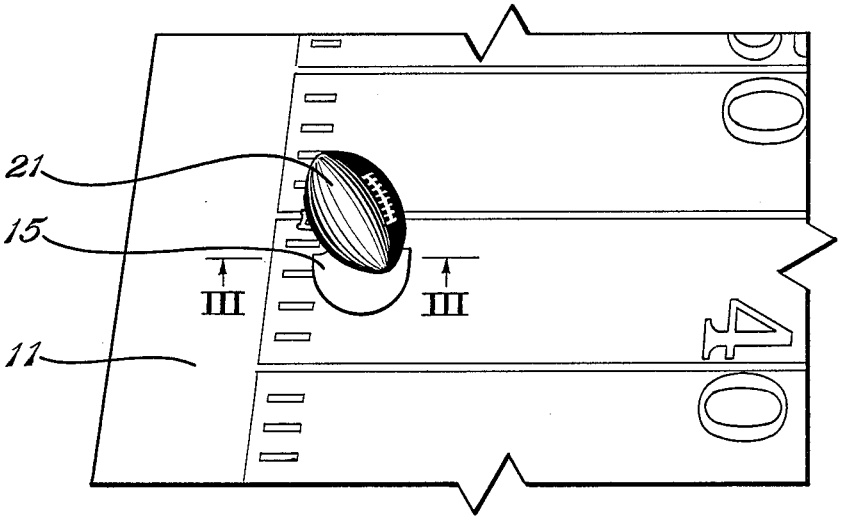
FIG. 2 is a close up view of a player disk and a ball disk of the invention.
Figure 3:
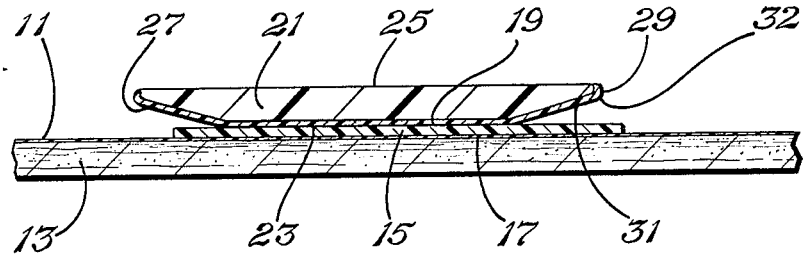
FIG. 3 is a sectional view of a playing board, a player disk, and a ball disk of the invention, as seen along lines III—III in FIG. 2.
Figure 4:
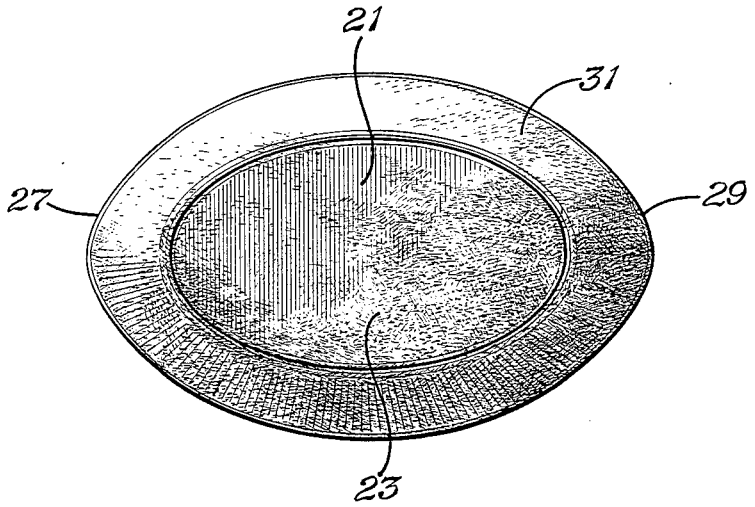
FIG. 4 is a bottom view of a ball disk of the invention.

As shown in FIGS. 1–3, the game apparatus of the invention has a playing board 11, which represents a football field. The playing board 11 is laid out flat on a table 13 or on the floor. Yard lines and other typical markings of a football field are printed on the upper side of the playing board 11. The playing board 11 is preferably made of canvas, but it may be made of vinyl or some other flexible material. The flexibility of the canvas or vinyl allows the playing board 11 to be rolled up easily for storage when not in use.

The football players are represented by player disks 15, which are placed on the playing board 11. The player disks 15 are shaped like football helmets, and the player disks 15 for the different teams are painted different colors. Each player disk 15 has an area of approximately $1\frac{1}{2}$ to $1\frac{3}{4}$ square inches.

As seen in FIG. 3, the player disks 15 are relatively flat. The player disks 15 are preferably about 1/32 inch thick. The lower side 17 of each player disk 15 is smooth, having a relatively low coefficient of friction. This facilitates the movement of the player disks 15 around the surface of the playing board 11.

The upper side 19 of each player disk 15 is roughened, to give the upper side 19 a higher coefficient of friction than the lower side 17. The purpose of the roughened surface 19 of the player disks 15 will be explained later.

The football represented by a ball disk 21. The ball disk 21 is oblong, having a length of $2\frac{1}{2}$ to $2\frac{3}{4}$ inches in a width of $1\frac{1}{2}$ to $1\frac{3}{4}$ inches. The thickness is greater than the thickness of each player disk 15, and is preferably $\frac{1}{8}$ to 3/16 inch. The lower side 23 of the ball disk 21 is smaller than the upper side 25 of the ball disk 21. The edge 27 of the ball disk 21 has a rounded portion 29 and a beveled portion 31. The beveled portion 31 is beveled at an angle of 15 degrees with respect to the lower side 23. The ball disk 21 weighs between 3 and 5 grams, with the preferred weight being 4.3 grams. This is about three times the weight of each player disk 15.

The lower side 23 of ball disk 21 is covered by a layer of felt 32. The felt 32 allows the ball disk 21 to slide smoothly across the playing board 11. If the ball disk 21 is sliding at a high rate of speed, the ball disk 21 will pass over the player disks 15.

However, whenever the ball disk 21 passes over a player disk 15, at a lower rate of speed, the ball disk 21 will grab the upper side 19 player disk 15, and both disks 15, 21 will slide a short distance together. The disks 15, 21 thus simulate the catching of a pass and the subsequent running with the ball.

The game apparatus may also include other devices which are helpful in the play of the game. Such devices may include a pair of dice 33 and a yardage marker 35.

During the play of the game, the player disks 15 and the ball disk 21 are placed on the playing board 11, to represent football players and a football. The player disks 15 are moved on the playing board 11 according to game rules which approximate the rules of football.

A forward pass is simulated by thumping the ball disk 21 with a finger 37. This propels the ball disk 21 toward a selected player disk 15. If the force and the direction of the thumping is accurate, the ball disk 21 will slide across the playing board 11 onto the selected player disk 15.

Because of the roughened upper side 19 of player disk 15, and the felt cover 32 of the ball disk 21, the ball disk 21 will stop on the player disk 15, unless the force of the thumping was excessive. If the proper speed is achieved, the ball disk 21 will catch and drag the player disk 15 for a distance of several inches. Excessive force will cause the ball disk 21 to slide completely across the player disk 15.

The game apparatus and method of the invention have several advantages over the prior art. The game and method of the invention simulates the flight of a ball which has been thrown, and yet the game gives a realistic chance for each of the possible results. During the play of the game, there is a realistic chance for a completed pass, and intercepted pass, or an incomplete pass.

The invention has been shown in only one of its forms. It should be apparent to those skilled in the art that it is not so limited, but is susceptible to various changes and modifications without departing from the spirit thereof. For example, either one ball disk or the player disk, may have a beveled edge.

I claim:

1. A game apparatus, comprising:

a flat playing board, representing a playing field;

a player disk, representing a player;

a ball disk, representing a ball;

the player disk being sufficiently thin and flat to enable the ball disk, when properly propelled, to slide on top of the player disk, with the lower side of the ball disk being in contact with the upper side of the player disk;

wherein one of the sides of the player disk and the ball disk has beveled edges, to facilitate the ball disk sliding over the player disk when the ball disk is propelled across the playing board; and wherein the ball disk has a fabric means layer of fabric on its lower side to facilitate retaining of the ball disk on the player disk once it slides onto the player disk.

2. A game apparatus, comprising:

a flat playing board, representing a playing field;

a player disk, representing a player;

a ball disk, representing a ball;

the player disk being sufficiently thin and flat to enable the ball disk, when properly propelled, to slide on top of the player disk, with the lower side of the ball disk being in contact with the upper side of the player disk;

wherein one of the sides of the player disk and the ball disk has beveled edges, to facilitate the ball disk sliding over the player disk when the ball disk is propelled across the playing board; and wherein the lower side of the ball disk has a smoother texture than the upper side of the player disk, so that the ball disk will slide smoothly across the playing board, and stop on the player disk if propelled at the proper speed.

3. A game apparatus, comprising:

a flat playing board, representing a playing field;

a player disk, representing a player;

a ball disk, representing a ball;

the player disk being sufficiently thin and flat to enable the ball disk, when propely propelled, to slide on top of the player disk, with the lower side of the ball disk, being in contact with the upper side of the player disk;

wherein one of the sides of the player disk and the ball disk has beveled edges, to facilitate the ball disk sliding over the player disk when the ball disk is propelled across the playing board;

wherein the lower side of the ball disk has a smoother texture than the upper side of the player disk, so that the ball disk will slide smoothly across the playing board, and stop on the player disk if propelled at the proper speed; and wherein the upper side of the player disk has a rougher texture than the lower side of the player disk, so that the ball disk will stop on top of the player disk, if the ball disk is propelled across the player disk at a proper speed.

4. A game apparatus, comprising:

a flat playing board, representing a playing field;

a thin, flat player disk, representing a player;

a ball disk, representing a ball, wherein the ball disk has beveled edges on the perimeter of its lower surface, so that the ball disk will slide over the player disk when the ball disk is propelled across the playing board; and a soft fabric layer means on the lower side of the ball disk, the fabric layer means and the top of the player disk providing sufficient surface adhesion to facilitate retaining the ball disk on the player disk once the ball disk slides onto the player disk, the fabric layer means having a smoother texture than the upper side of the player disk.

5. A game apparatus, as recited in claim 4, wherein the thickness of the ball disk is greater than the thickness of each player disk.

6. A game apparatus, as recited in claim 5, wherein the weight of the ball disk is greater than the weight of each player disk.

7. A method of playing a game, comprising the steps of:

providing a player disk with an upper surface and a ball disk with a lower surface that adhere to each other sufficiently to cause the ball disk to stay on the player disk when propelled at the proper velocity; then placing the player disk, representing a player, on a flat playing board;

placing the ball disk, representing a ball, on the playing board, wherein a selected one of the player disk and the ball disk have beveled edges;

propelling the ball disk across the playing board, sliding the ball disk onto the player disk and retaining the ball disk on the player disk.

8. A method of playing a game, as recited in claim 7, wherein the step of propelling the ball disk further comprises thumping the ball disk with a finger.

* * * * *